US006019289A

United States Patent [19]

Sung

[11] Patent Number: 6,019,289

[45] Date of Patent: Feb. 1, 2000

[54] MODULAR TRACK SEGMENT FOR MODEL RAILROAD TRACK AND ELECTRICAL ACCESSORY THEREFOR

[75] Inventor: Kiho Sung, Seoul, Rep. of Korea

[73] Assignee: Mike's Train House, Inc., Columbia, Md.

[21] Appl. No.: 09/008,093

[22] Filed: Jan. 16, 1998

[51] Int. Cl.[7] ..... E01B 23/00

[52] U.S. Cl. ..... 238/10 E; 238/10 R; 238/10 A; 238/14.14; 104/DIG. 1; 191/29 R

[58] Field of Search ..... 104/DIG. 1, 288, 104/304, 305; 238/10 R, 10 A, 10 E, 10 F, 14.14; 191/29 R

[56] References Cited

U.S. PATENT DOCUMENTS

| | | | |
|---|---|---|---|
| 2,871,308 | 1/1959 | Petit | 191/29 R |
| 3,074,647 | 1/1963 | Bonanno | 238/10 A |
| 4,231,517 | 11/1980 | Cheng | 191/22 C |
| 4,709,856 | 12/1987 | Rother et al. | 238/10 E |
| 4,953,785 | 9/1990 | Keska | 238/10 E |

OTHER PUBLICATIONS

"*Marklin C Track*" Advertisement, Dated "1996E" (8 sheets).

*Primary Examiner*—Mark T. Le
*Assistant Examiner*—Robert J. McCarry, Jr.
*Attorney, Agent, or Firm*—Dann, Dorfman, Herrell & Skillman

[57] ABSTRACT

A modular track segment for a model railroad track includes a plurality of conductive strip members secured to the lower surface of the segment and in electrical connection with respective rails on the upper surface of the track segment. Respective forward portions of the conductive strip members are formed to provide accurate leaf springs for mutually-compressive electrical contact with corresponding strip members of an adjacent track segment. Mechanical features of the track segment provide engagement of adjacent track segments and reinforce the compressive contact between adjacent conductive strip members. A breakaway access member is provided along a side wall of the track segment to form an opening for electrical and mechanical connection of an electrical accessory to the track segment.

21 Claims, 3 Drawing Sheets

MODULAR TRACK SEGMENT FOR MODEL RAILROAD TRACK AND ELECTRICAL ACCESSORY THEREFOR

FIELD OF THE INVENTION

The present invention relates to model railroad track. In particular, the present invention relates to a modular track segment for O-gauge model railroad track, providing simultaneous mechanical and electrical intercoupling between the segment and an adjacent segment in a reliably reconfigurable manner.

BACKGROUND

A traditional model railroad track segment consists of a pair of conductive rails held in a parallel spaced relationship by a plurality of tie members. In order to construct a model railroad layout, track segments are joined together by sliding opposing ends of adjacent rails into conductive rail joiners. The rail joiners consist of a generally rectangular piece of conductive sheet metal that has been crimped to provide a passageway about as wide as the flared bottom of a rail, and having a slot formed along the length of the passageway to accommodate sliding each rail into the joiner. The crimped sides of the joiner provide a compressive engagement with the bottom end portions of the respective rails so joined.

A common problem associated with constructing a traditional model railroad layout is that each joiner must provide good electrical contact with each rail in order to maintain series electrical connection among all of the rail segments in the layout. If the layout is altered from time to time, metal fatigue in the joiners can cause unreliable electrical contact with the rails. Poor contact between one rail and one joiner can render the entire layout inoperative.

Because the traditional track segments are relatively lightweight, and the joiners do not provide adequate resistance to flexing forces that are applied to the rails during assembly or operation, it is necessary to fasten the track segments to a rigid substrate, such as plywood, to prevent the joiners from becoming loose. The necessity for such attachment is discouraging to potential model railroading enthusiasts who lack the requisite storage space for a large layout, or who would not desire to construct a single permanent layout configuration. To address this problem, modular track segments have recently become available wherein rails are permanently attached to a rigid base, which is provided with connectors at each end for mechanically joining segments together to form a layout. Some of the commercially available modular track segments provide mechanical connection between adjacent rail segments, but rely upon traditional track joiners to provide electrical connection between adjacent rail segments.

U.S. Pat. No. 4,709,856 describes a modular track segment for an HO-scale model railroad, which provides mechanical and electrical connection between the rails of adjacent segments. Electrical connection is provided by pairs of spring wires extending from one end of a segment, which are configured to receive therebetween a conductive projection situated on an end of an adjoining segment, to provide a wiping contact between the spring wires and the conductive projection. Hence, the reliability of the electrical connection depends on the long-term elasticity of the spring wires, which may deteriorate over the course of repeated coupling and de-coupling.

SUMMARY

In accordance with the present invention, there is provided a modular track segment for constructing a model railroad. Electrical connection between adjacent segments is established by an opposing, mutually-compressive configuration of arcuate leaf springs provided at opposing adjacent coupling ends of the track segments. Coupling ends of the adjacent track segments are provided with mechanical alignment members which also provide compression channels for reinforcing compressive contact between the arcuate lead springs of the respective track segments.

Electrical connection between corresponding rails of adjacent track segments is established by unitary conductive strip members secured to the bottom surface of each track bed. The conductive strip members are each formed to have a base portion for attachment to the bottom surface of the track bed, one or more upwardly extending wing portions for connection with a rail, and a forward portion forming the arcuate leaf spring for compressive contact with a corresponding leaf spring portion of an adjacent track segment.

Also in accordance with the present invention, the track bed is provided with a detachable "punch-out" portion providing access for electrical connection with the conductive strip members. The conductive strip members are configured to provide respective electrical receptacles for connection with complementary contact members of an electrical accessory. The track bed is further configured to provide secure mechanical engagement with the electrical accessory. Other aspects and advantages of the present invention shall be made apparent in the following drawings and detailed description of the invention.

BRIEF DESCRIPTION OF THE DRAWING

The foregoing summary as well as the following detailed description of the preferred embodiments of the present invention will be better understood when read in conjunction with the appended drawings, in which.

DETAILED DESCRIPTION

Figure 1:
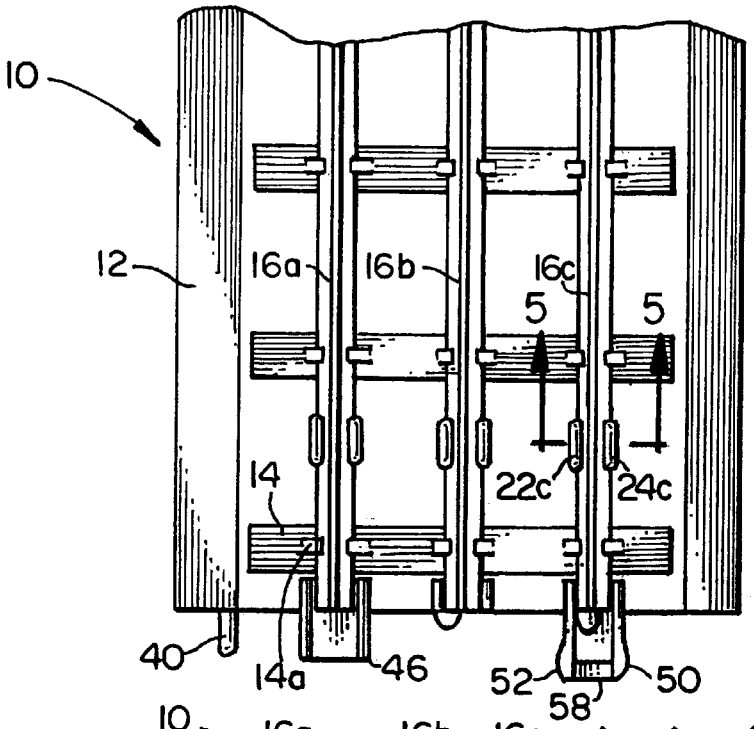
FIG. 1 is a partial top plan view of a model railroad track segment according to the present invention.

Referring now to FIG. 1, there is shown a coupling end of a model railroad track segment 10. The track segment 10 comprises a track bed 12, ties 14, and rails 16*a–c*. In the preferred embodiment, there are three rails 16*a–c* in accordance with the O-gauge model railroad standard. Each of the rails 16*a–c* has a flared bottom and is similar in cross section to an actual railroad track. The tics 14 are secured to the track bed, and include straps 14*a* for gripping the flared bottom portion of the rails to secure the rails to the track bed. The rails 16*a–c* extend along the track bed in parallel spaced relationship and terminate at the end of the track bed 12.

Figure 3:
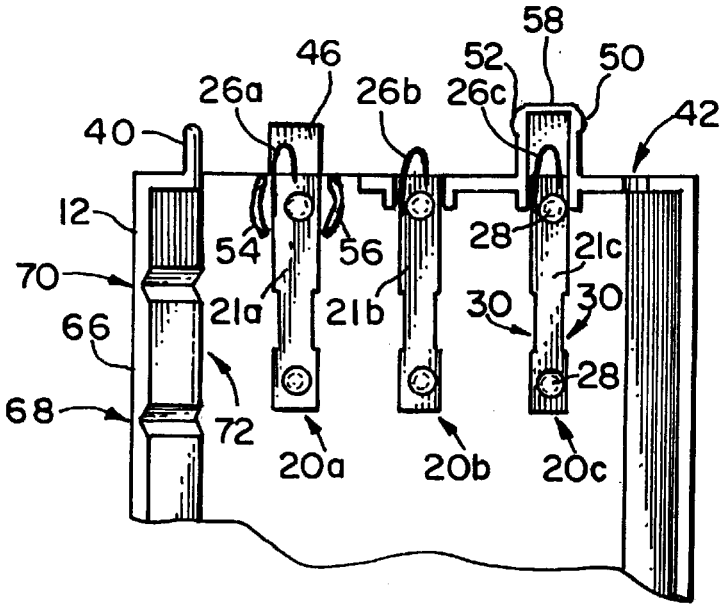
FIG. 3 is a partial bottom plan view of the model railroad track segment of FIG. 1.
Figure 5:
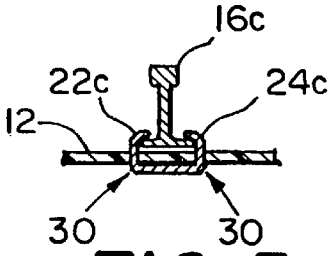
FIG. 5 is a sectional view of the model railroad track segment taken along the line 5—5 of FIG. 1.

Referring now to FIG. 3, conductive strip members 20*a–c* are secured to the bottom surface of the track bed 12. The conductive strip members 20*a–c* provide electrical connection between the respective rails 16*a–c* and the corresponding rails of an adjacent track segment (not shown) when the track segment 10 is joined to the adjacent track segment to construct a model railroad layout. Conductive strip member 20*c*, for example is preferably formed of a single piece of conductive sheet metal, such as brass, having a base portion 21*c*. The base portion 21*c* may be secured to the bottom surface of the track bed 12 by any convenient means, such as thermally-expanded bosses 28 which are integrally formed with the track bed 12 and extend through holes formed in the base portion 21*c* of conductive strip member 20*c*. As best seen in FIG. 5, the conductive strip member 20*c* further includes rail-contacting wings 22*c* and 24*c*, which extend upwardly through slots 30 in the track bed 12. The wings 22*c* and 24*c* are folded or bent at respective upper ends thereof to grip the lower flared portion of rail 16*c*. To provide secure contact between the rails and the wings, an additional aperture (not shown) may be formed in the track bed directly beneath each rail, to allow the respective conductive strips to be connected with the underside of corresponding rails, e.g. by spot-welding. Similarly, strip members 20*a* and 20*b* are constructed like strip member 20*c* and include wings extending upwardly to grip the lower flared portions of rails 16*a* and 16*b*. The forward ends of the respective base portions 21*a–c* of conductive strip members 20*a–c* terminate flush with the coupling end of the track segment 10.

Figure 2:
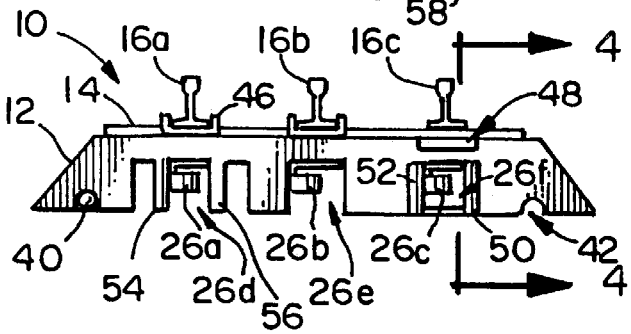
FIG. 2 is an elevational view of a coupling end of the model railroad track segment of FIG. 1.

Referring again to FIG. 3, at the forward end of each conductive strip member, a side extension portion is folded over and bent backwards to form respective arcuate leaf spring portions 26*a–c* which extend outwardly beyond the end of the track bed 12. The arcuate leaf spring portions 26*a–c* each also extend beyond the coupling end of the track segment 10. As can be seen in FIGS. 2 and 3, the curvature of the arcuate leaf spring portions 26*a, b* and *c* are preferably formed such that the rearward end of each leaf spring portion extends laterally more than halfway across the electrical coupling openings, generally designated 26*d, e* and *f*, respectively, in the end of the track segment in which the leaf spring portions are positioned for connection.

The coupling end of the track segment 10 is provided with several features for assuring proper mechanical connection and alignment between adjacent track segments. As can be seen in FIG. 1 and FIG. 2, an alignment boss 40 extends from the lower left side of the coupling end of the track segment 10, and a mating alignment boss-receiving opening 42 is formed on the lower right side of the connection end of the track segment 10. It should be appreciated that opposite ends of the track segment 10 are formed to have complementary mechanical features, such that respective forward and rear ends of each track segment can be joined with corresponding complementary ends of adjacent track segments.

Figure 4:
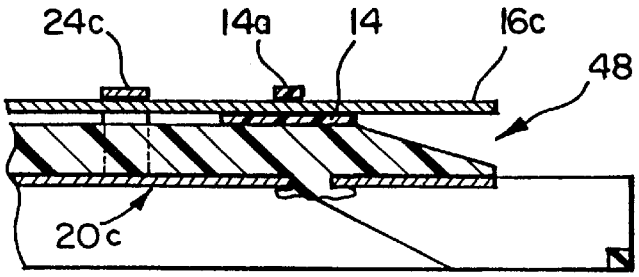
FIG. 4 is a sectional view of the model railroad track segment taken along the line 4—4 shown in FIG. 2.

A trough-like alignment member 46 aligned with rail 16*a* extends forwardly from the upper edge of the track bed. The bottom surface of the alignment member 46 is tapered to be received into a corresponding tapered recess of an adjacent track segment. As can be seen in FIG. 4, such a tapered recess 48 is provided along the upper surface of the track bed 12 for receiving a complementary alignment member 46. When the track segment 10 is joined to an adjacent track segment, the flared lower portion of rail 16*c* is received into a trough-like alignment member of similar construction as alignment member 48.

When the track segment 10 is joined to an adjacent track segment, the mechanical alignment provided by alignment members 40 and 46 is secured by a compressive, snap-fit engagement provided by reception of a pair of outwardly-flared fingers 50 and 52 extending from the forward end of the track segment 10 into a pair of inwardly-bowed jaws, such as jaws 54 and 56, formed on the bottom surface of the track segment 10. The fingers 50 and 52 are inter connected at lower interior sides by a cross-tie 58 in order to strengthen and maintain a consistent outward separation between the fingers 50 and 52 to maintain compressive engagement of the flared portions of the fingers within complementary inwardly-curved portions of the respective jaws 54 and 56 of the adjacent track segment.

Figure 6:
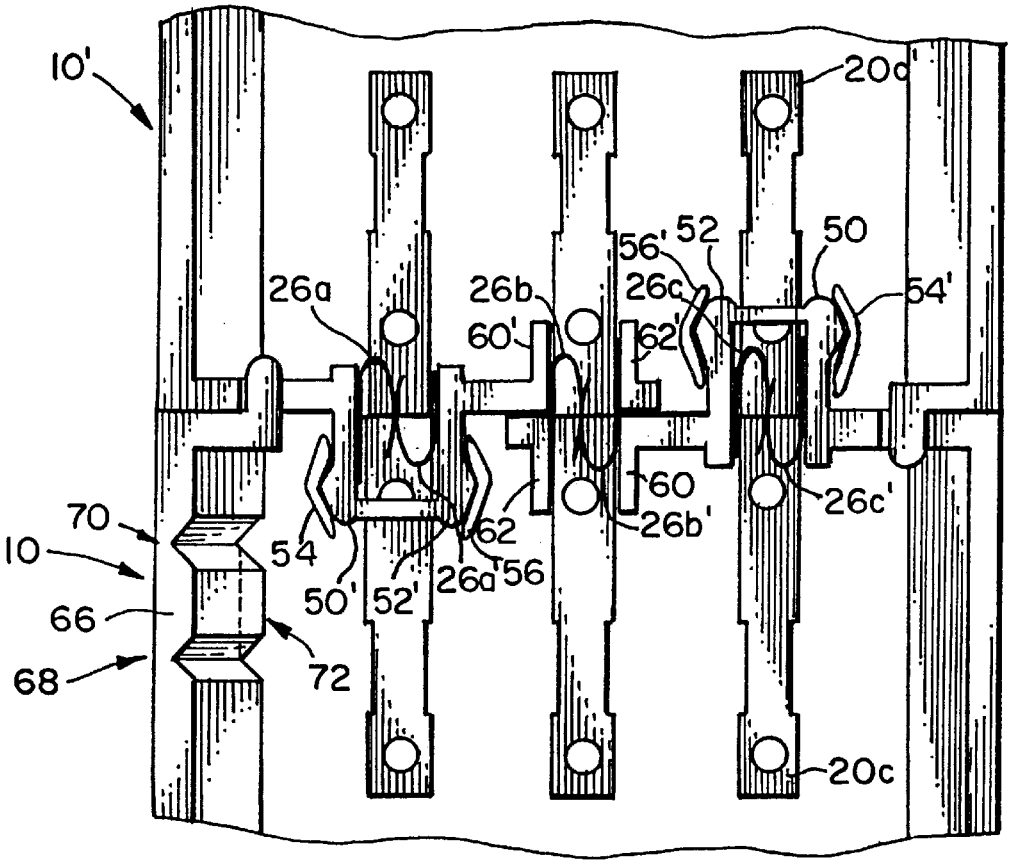
FIG. 6 is a partial bottom plan view showing two model railroad track segments in a coupled configuration.

Referring now to FIG. 6, the track segment 10 is shown in a coupled configuration with an adjacent track segment 10'. The positioning of leaf spring portion 26*c* of conductive strip member 20*c* between fingers 50 and 52, and the lateral extension of leaf spring portion 26*c* by more than half the distance between interior surfaces of the fingers 50 and 52, provides a secure mutually-compressive engagement with the leaf spring portion 26*c* of the conductive strip member 26*c'* secured to the bottom surface of adjacent track segment 10'. Additionally, the inner surfaces of the fingers 50 and 52 form a channel providing additional inward compressive force against leaf spring portions 26*c* and 26*c'* to resist the tendency of the leaf spring portions to warp outwardly during repeated coupling and de-coupling to provide different layout configurations. Thus, strong mechanical and electrical connections are maintained between coupled track segments.

As can also be seen in FIG. 6, leaf spring portions 26*a* and 26*a'* are similarly constrained within a compression channel by fingers 50' and 52' extending from the adjacent track segment 10' into the jaws 54 and 56 provided on the bottom surface of track segment 10. The central leaf spring portions 26*b* and 26*b'* are also constrained within a compression channel against outward lateral warping-by ribs 60 and 62 and by ribs 60' and 62' formed on the respective lower surfaces of the track segments 10 and 10'. Hence, in the coupled configuration, corresponding rails of adjacent track segments are electrically connected by conductive paths from each rail on one track segment, through the wings of the respective conductive strip portions, then through the base portions to the leaf springs, across the mutually-compressed leaf springs into the base portions of the adjacent conductive strip portions, and then through the wings of the adjacent conductive strip portions to the adjacent rails.

In order to provide for electrical connection of a model railroad transformer or other electrical accessory to the rails 16*a–c*, access to the conductive strip portions may be provided by an integral "punch-out" or break away access member 66 formed along one side of the track bed 12. The punch-out member 66 is provided by forming parallel reduced-thickness portions or grooves 68 and 70 along the bottom interior sides of the track bed 12, and a reduced-thickness joint 72 along an interior upper edge of the bottom of the track bed 12. In order to separate the punch-out member 66 from the track bed 12, the reduced-thickness portions 68 and 70 can be cut with a knife, and then the punch-out member 66 is broken away from the track bed 12 by repeatedly flexing the punch-out member to weaken and ultimately break the joint 72. Hence, the bottom surface of the track bed 12 may be maintained in flush contact with a substantially flat surface, while electrical connections can be made through the opening thus provided by the punch-out member to the conductive strip members. In various alternative embodiments, electrical connection may be facilitated by providing spade lugs, screw terminals, or spring-release compressive contacts on the respective bottom surfaces of the conductive strip members.

Figure 7:
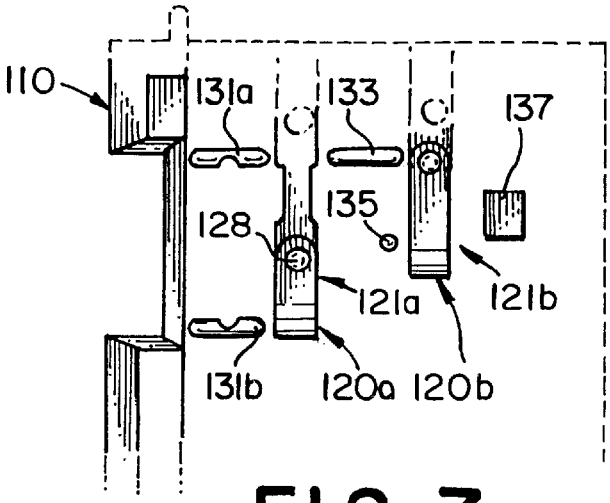
FIG. 7 is a partial bottom plan view of a track segment, showing structure for electrically and mechanically interconnecting an electrical accessory.
Figure 8:
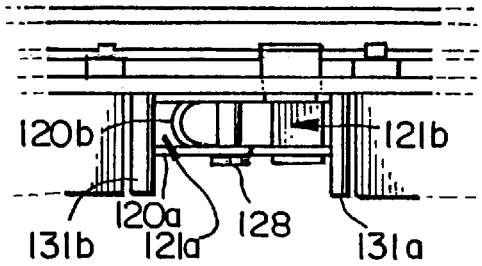
FIG. 8 is a side elevational view of the track segment of FIG. 7.

In a preferred embodiment, the conductive strip members may be formed to provide receptacles for receiving electrical contacts of a compatibly-configured electrical accessory. For example, referring now to FIG. 7, there is shown the underside of a track segment 110. Conductive strip members 120A and 120*b* are secured to the underside of the track segment 110 to provide electrical interconnection between the rails of adjacent track segments. The forward ends of the conductive strip members may be formed to provide or connect with respective spring portions (not shown) for mating with conductors of an adjacent track segment in the manner herefore described. Respective rear portions of each of the conductive strip members are bent or folded over to form respective conductive receptacles 121*a* and 121*b* between the resulting upper and lower surfaces of the folded rear portions of the conductive strip members 120*a* and 120*b*, as can be seen in FIG. 8. The separation distance between the upper and lower surface of the folded rear portions of the conductive strip members is maintained by thermally-expanded bosses, such as the boss 128 which extends through the lower and upper portions of strip member 120A and further serves to secure the strip member 120A to the underside of the track segment 110. The electrical receptacles thus provided by the conductive strip members 120*a* and 120*b* are aligned with the opening formed on the side of the track segment 110 by removal of a punch-out member (not shown), as described above. Additionally, the receptacles are relatively staggered along the longitudinal axis of the track segment to accommodate insertion therein of a pair of adjacent electrical contacts of a compatibly-formed electrical accessory.

Figure 9:
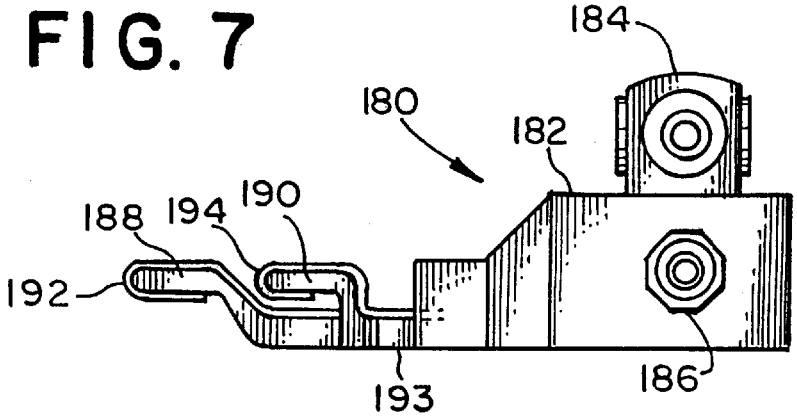
FIG. 9 is a side elevational view of an electrical accessory configured for interconnection with the track segment of FIG. 7.

One such electrical accessory configured for connection for the track segment 110 is a signal light assembly shown in FIG. 9. The assembly 180 comprises a housing 182 for containing electrical components, such as circuitry for lighting a lamp 184. External electrical connectors, such as a banana jack 186, may be provided on the exterior of the housing for supplying electrical power to the track and the accessory, or for drawing electrical power from the track to supply yet other accessories with power. A pair of arms 188 and 190 extend from the housing. The arms 188 and 190 provide mechanical support for respective contact members 192 and 194 mounted thereon. The distal ends of the arms are preferably about as thick as the separation distance between the respective upper and lower surfaces of the folded ends of the strip members 120*a* and 120*b*. The contact members 192 and 194 may be provided in the form of conductive strips that are folded about respective ends of the arms 188 and 190 to provide contact surfaces on the arms. The contact member 192 and 194 extend along respective arms 188 and 190 into the housing. In the preferred embodiment, the arms 188 and 190 each extend from a common base member 193 forming the base of the electrical accessory, and the distal ends of the arms are elevated relative to the base to engage the conductive strip members mounted to the underside of the track segment. Arm 188 is longer than arm 190 in order to extend to a conductive strip member 120*b* that is connected with a rail which is further from the attachment side of the track segment than conductive strip member 120*a*.

Figure 10:
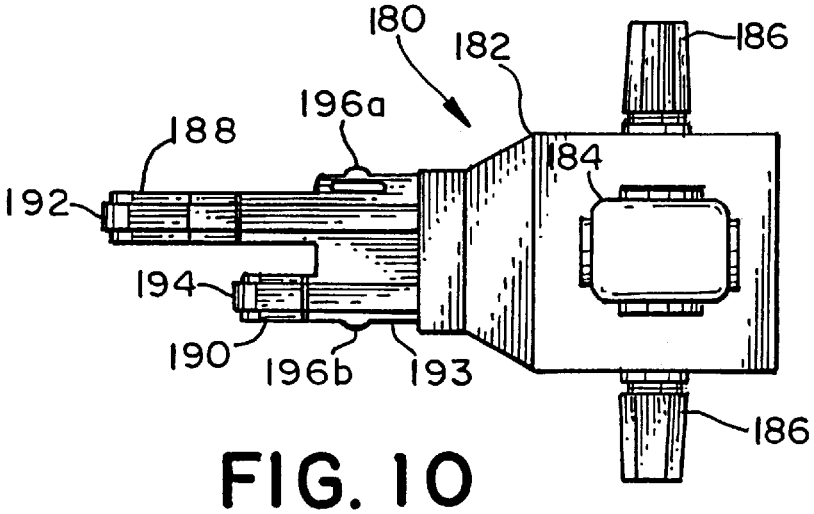
FIG. 10 is a top plan view of the electrical accessory of FIG. 9.

The electrical accessory assembly 180 and the track segment 110 are preferably configured to provide secure mechanical engagement between the accessory 180 and the track segment 110, in addition to electrical interconnection. As can be seen in FIG. 10, detents 196*a* and 196*b* are provided on respective sides of the electrical accessory 180, such as upon respective sides of the base 193. The detents 196*a* and 196*b* are configured to engage complementary grooves formed in a pair of opposed alignment members 131*a* and 131*b* which, as shown in FIGS. 7 and 8, are formed on the underside of the track segment 110 and extend downwardly adjacent respective sides of the opening provided in the side of the track segment 110 for insertion of the arms of the electrical accessory assembly 180. Further alignment members may be provided on the underside of the track segment, such as alignment rail 133 and post 135 for guiding arm 188 of the assembly 180 into position. An abutment 137 is provided on the underside of the track segment 110 to prevent further forward motion of the assembly 180 after the arms of the assembly 180 have been fully inserted into the track segment 110, and the detents 196*a* and 196*b* have been engaged by the alignment members 131*a* and 131*b*.

The terms and expressions which have been employed are used as terms of description and not of limitation. There is no intention in the use of such terms and expressions of excluding any equivalents of the features shown and described or portions thereof. It is recognized, however, that various modifications are possible within the scope and spirit of the invention as claimed. For example, it will be appreciated that the features of the electrical accessory assembly 180 have been described in connection with a signal lamp 184, such features are readily adapted for use with other accessories desirable in model railroading, such as switches, crossing signals, transformers, and the like.

That which is claimed is:

1. A model railroad track member, comprising:

a track bed having an upper surface, a lower surface, and a pair of coupling ends;

at least first and second parallel rails positioned on the upper surface of the track bed;

first and second conductive strip members secured to the lower surface of the track bed, each strip member having:

a spring portion forming an arcuate leaf spring extending from a coupling end of the track bed; and a rail-contacting portion extending through the track bed for electrically connecting the spring portion with a corresponding one of the first and second rails.

2. The model railroad track member of claim 1 comprising a pair of outwardly-flared fingers extending from a coupling end thereof, and a pair of complementary inwardly-compressive jaws formed in the lower surface thereof for securing mechanical engagement with a complementarily formed adjacent track member.

3. The model railroad track member of claim 2 wherein one of said spring portions is positioned to extend from the coupling end at a position along an inner surface of one of said fingers, and wherein the curvature of said one spring portion is selected to provide a lateral extent of said spring portion that is greater than half the distance between interior surfaces of the pair of fingers, whereby the interior surfaces of the fingers provide an inward compressive force against the leaf spring when track members are positioned in a coupled configuration with an adjacent complementarily formed track member.

4. The model railroad track of claim 1 wherein the track bed comprises a breakaway access member defined by reduced thickness portions of the track bed for facilitating connection of an electrical connection with the conductive strip members.

5. The model railroad track of claim 1 comprising a third rail positioned in a parallel spaced arrangement with the first and second rails to form an O-gauge model railroad track.

6. The model railroad track member of claim 1 wherein each of the rails comprises a bottom flared portion, and wherein the conductive strip members each comprise a wing portion extending upwardly through the track bed and forming an overlapping engagement with the bottom flared portion of a respective rail.

7. A modular track segment for a model railroad track, comprising:

a track bed having an upper surface, a lower surface, and a side wall;

a plurality of rails positioned on the upper surface of the track bed;

a breakaway access member forming a part of the side wall of the track bed and configured for removal therefrom to provide an opening in the track bed;

an electrical receptacle secured to the lower surface of the track bed in electrical connection with one of the rails and positioned adjacent the opening for connecting with an electrical contact member of an electrical accessory.

8. The modular track segment of claim 7 wherein the electrical receptacle is provided by a conductive strip member having an arcuate spring portion extending beyond a connecting edge of the track bed for providing electrical interconnection with an adjacent track segment.

9. The modular track segment of claim 8 wherein the conductive strip member comprises an upwardly extending porting in electrical contact with said one rail.

10. The modular track segment of claim 8 wherein the conductive strip member comprises a rear portion having a partial loop formed therein for providing respective upper and lower surfaces of the electrical receptacle.

11. The modular track segment of claim 7 wherein the track bed comprises mechanical engagement means for securing mechanical engagement between the track bed and the electrical accessory.

12. The modular track segment of claim 11 wherein the mechanical engagement means comprises an alignment member positioned on the lower surface of the track bed adjacent the opening for aligning the electrical accessory with the receptacle during insertion and for thereafter maintaining mechanical engagement between the track bed and the accessory.

13. In a model railroad track assembly, an electrical accessory comprising:

a housing;

a first arm extending from the housing, formed to be inserted into an opening provided in a track bed of a modular railroad track segment;

a first electrical contact member positioned on the first arm for mating with a first receptacle secured to the track segment.

14. The invention of claim 13, comprising mechanical engagement means connected with the housing and configured to provide mechanical engagement between the housing and the track bed.

15. The invention of claim 14, comprising:

a second arm extending from the housing adjacent the first arm;

a second electrical contact member positioned on the second arm for mating with a second receptacle secured to the track segment.

16. The invention of claim 15, comprising electrical connectors on the exterior of the housing for providing external electrical connection with the respective first and second receptacles.

17. A model railroad track member, comprising:

an electrically insulating track bed having an upper surface, a lower surface, and a pair of coupling ends;

at least first and second parallel rails positioned on the upper surface of the track bed;

first and second conductive strip members secured to the lower surface of the track bed and thereby insulated from each other, each strip member having:

a spring portion forming an arcuate leaf spring extending from one of the coupling ends of the track bed; and a rail-contacting portion extending through the track bed for electrically connecting the spring portion with a corresponding one of the first and second rails.

18. The model railroad track member of claim 17 wherein said first and second conductive strip members are formed to provide receptacles to receive respective terminals of an external model railroad accessory.

19. The model railroad track member of claim 18 wherein the track bed has a trapezoidal cross section, and wherein grooves are formed in a side of the track bed to provide a breakaway portion of the track bed adjacent to the receptacle for insertion of the terminals of the external model railroad accessory in a direction perpendicular to the rails.

20. The model railroad track member of claim 4 wherein the breakaway access member is formed in a side wall of the track bed to provide an opening for insertion of an electrical accessory into the opening in a direction perpendicular to the rails.

21. The model railroad track member of claim 8 wherein the breakaway access member is formed in a side wall of the track bed to provide an opening for insertion of an electrical accessory into the opening in a direction perpendicular to the rails.

* * * * *